US005875956A

United States Patent [19]

Benarrouch

[11] Patent Number: 5,875,956

[45] Date of Patent: Mar. 2, 1999

[54] PACKAGE FOR CYLINDRICAL SANDWICH AND THE LIKE

[75] Inventor: Jacques Benarrouch, Villeurbanne, France

[73] Assignee: The Mead Corporation, Dayton, Ohio

[21] Appl. No.: 693,307

[22] PCT Filed: Feb. 15, 1995

[86] PCT No.: PCT/FR95/00181

§ 371 Date: Nov. 12, 1996

§ 102(e) Date: Nov. 12, 1996

[87] PCT Pub. No.: WO95/21781

PCT Pub. Date: Aug. 17, 1995

[30] Foreign Application Priority Data

Feb. 15, 1994 [FR] France ..... 94 01949
Nov. 22, 1994 [FR] France ..... 94 14244

[51] Int. Cl.[6] ..... B65D 5/42

[52] U.S. Cl. ..... 229/110; 229/103.2; 229/122; 229/906; 229/938

[58] Field of Search ..... 229/103.2, 108, 229/110, 115, 122, 902, 906, 938

[56] References Cited

U.S. PATENT DOCUMENTS 2,950,853 8/1960 Weiss ..... 229/110
3,391,782 7/1968 Kaspar ..... 229/103.2
3,581,708 6/1971 Beck et al. ..... 229/122
3,738,564 6/1973 Persson ..... 229/110
4,137,333 1/1979 Daswick ..... 426/120
4,428,525 1/1984 Brauner ..... 229/122

FOREIGN PATENT DOCUMENTS 214430 10/1909 Germany ..... 229/103.2

*Primary Examiner*—Gary E. Elkins
*Attorney, Agent, or Firm*—Thomas A. Boshinski

[57] ABSTRACT

A package for a food product such as a cylindrical sandwich includes an elongate central strip having a plurality of fold lines defining a series of panels. A central panel of the series includes a central flap connected at each side edge, and other closure flaps are connected to at least some of the other panels. The panels are folded with respect to each other so that the endmost panels are positioned to define a polygonal cross-section for the package. The closure flaps and central flaps are folded to close the package. An outer portion of each central flap is free from the remaining closure flaps to permit outward folding of the panels for access to the food product. Several alternative embodiments are disclosed.

9 Claims, 16 Drawing Sheets

PACKAGE FOR CYLINDRICAL SANDWICH AND THE LIKE

BACKGROUND OF THE INVENTION

The present invention relates to a pack for cylindrical, hamburger-type sandwiches. More generally, it relates to a pack for any rather compact food presented in a cylindrical shape and intended to be eaten in the pack.

The hamburger being the most popular cylindrical sandwich, the descriptions shall be based on the application to the wrapping of hamburgers, as the wrapping of hamburgers is a delicate operation, inasmuch as it deals with a soft, open and layered sandwich, with dripping sauces and greasy debris which can fall and soil the consumer's clothing if the hamburger is not systematically supported from beneath in its pack during the entire consumption time.

There are two principal known types of hamburger packs-one is a hinged box in the shape of double trays, generally of square cross section, with a snap-in locking system. Currently, for environmental reasons these packs are preferably made of a light-weight flat or micro-flute paperboard; these trays are preformed in an automatic gluing operation.

The hamburger is placed flat in the lower tray, and the consumer must bring it upright, requiring that he delicately slide the index and/or second finger of one hand between the hamburger and the bottom of the lower tray to lift the hamburger with his thumb, in a very uncomfortable gesture, just as uncomfortable as holding the same lower tray with the other hand to protect against spots during consumption, while the upper tray hinged on the lower tray may hit his face during the eating process.

Moreover, children tend to eat the sandwich outside the tray, thereby frequently soiling their clothing.

Other packs are merely very thin rectangular sheets of paper which are wrapped around the hamburger in the manner any flat cylindrical object is wrapped, by tucking the extending edges of the folded paper under the wrapped item.

In addition, there is a very thin, longitudinally pleated wrap, where the pleats are secured at the end by lateral seals, the paper having a polyethylene coating serving as a hot-melt glue to allow it to be sealed.

This manual pack is very difficult to adjust, it is rather unattractive once in place, and has not met with the expected success.

According to another method described in U.S. Pat. No. 4,189,054, a cylindrical box for the packing of round sandwiches consists of two half-shells, each surrounding the sandwich over half of its perimeter, and connected to each other along a single hinge parallel to the generatrix of the cylinder. In the closed position, each shell comes into edge-to-edge contact with the other. During the filling operation, the sandwich is placed upright into the lower shell, and the upper shell is lowered on the lower shell.

During consumption, the sandwich is held in the lower shell which can either be torn along its radius, or folded outward laterally along the hinge in the generatrix of the cylinder. This pack is produced by polyurethane foam molding and has several disadvantages. Since the peripheral and lateral walls are perpendicular to each other and molded, the packs are not stackable; the sandwich is too ensconced at the bottom of one shell while the other shell hits the consumer's face, which is most uncomfortable, particularly during the end phase of consumption as the radial tear-out of the half-shell as well as the lateral tear-out features provided to access the last portion of the sandwich with the mouth are awkward and require a strong pull on the pack which may suddenly give way and possibly dislocate the sandwich, and cause food scraps to shower on the consumer or his neighbors.

To our knowledge, this pack has never actually been used for these reasons.

Differently, U.S. Pat. No. 4,494,785 relates to a precut and prepleated flexible paper napkin destined to partially cover a cylindrical sandwich allowing it to be held in one's fingers without them touching the food. It consists of a strip partially surrounding the periphery of the sandwich and of two series of parallel two-by-two flaps designed to fit between the fingers and the top and bottom of the sandwich respectively. This napkin stays around the sandwich only if it is held by the hand, and does not allow to effectively catch the sauce or greasy scraps escaping from the sandwich during its consumption, nor does it provide for thermal insulation of the hot sandwich.

The very old, German patent 336789 describes a rectangular parallelepiped box with square cross-section and cross-bottom closure obtained through the diagonal folding of the four bottom fields; this box is accessible from the bottom only; it mainly serves to wrap powdered or grain products, and possesses no specific characteristic for eating a round sandwich in its pack, even if one box may serve many different purposes.

U.S. Pat. No. 2,443,531 describes an hermetically sealed cubic box of rather thick paperboard, specifically designed to accommodate a cube of ice cream to be carried under the best possible conditions (mainly of temperature) between the point of purchase and the point of consumption.

The paperboard sheet is divided into equal square areas along three longitudinal strips, delimited by two parallel fold lines and five transversal strips delimited by four fold lines perpendicular to the former.

To consume the content, the box is placed on an horizontal table and redeployed in the plane of the table so that the ice cream remains on the central square area on which it can be cut and served. Granted perhaps that this box may accommodate a hamburger in a specific application, one cannot help but realize that it has not been designed for a hamburger to be eaten in its pack.

The round box disclosed in U.S. Pat. No. 2,224,504 consists of a cylinder made from a sheet of unspecified material, having a central section and lateral extensions, the length of which is exactly half the diameter of the product to be packed.

It is the material of these extensions which, by folding down on both sides of the apertures of the central cylinder along fan-shaped pleats, closes the cylinder and wraps a product compatible with this type of pack which can be opened from either side. The resulting pseudo-box possesses no useful characteristic for a hamburger pack, much less for the consumption of a hamburger from the pack as it does not have a stable sealed bottom.

As we know, it is designed to package deluxe soaps and other perfume items or gifts, preferably having two roughly parallel planes.

The paperboard container described in U.S. Pat. No. 2,295,508 forms a universal box with original assembling and locking, designed to hold fairly large volumes, but as a result has the usefulness of any non-specific traditional box, which was actually the inventor's intent as he was seeking the widest possible application as stated in the text of the patent.

The paperboard container in U.S. Pat. No. 3,031,124 features a very complicated manual folding system in no way suitable to large commercial preforming runs; while the esthetic result is quite pleasing, this satchel shaped pack does not offer any specific application, which was the intent of its inventor. In another perspective, had this pack held any specific interest for the consumption of a hamburger, surely this would have become known since 1959.

In 1963, U.S. Pat. No. 945,399 describes a wrapping process for various articles with a folded sheet, lined or impregnated with polyethylene in particular, but also with aluminum, and especially a means to utilize the lining material to heatseal the organized pleats and seal the pack through the application of a rigid thermoplastic label made from a compatible material and designed to display a brand name outside the pack.

We are far removed here from the concern for a specific hamburger pack.

The analyses of all above-mentioned packs and of many other existing food packs leads to the conclusion that while some of them may be used for a hamburger, none of them, including the currently used hinged boxes and the lined papers, offer nor do they claim to offer all of the required specifications allowing the easy and practical consumption in its pack of a hamburger or another compact food of cylindrical shape.

SUMMARY OF THE INVENTION

The following presentation of the Invention demonstrates that it uses different means for different functions and results, both compared to the currently known and used hamburger packs as well as compared to the disclosures of previously analyzed patents, which do not suggest, individually or in combination, the subject of the Invention; consequently, since the Invention, particularly in its third version, belongs to a special technical category, the man of the art could not be tempted to seek and to choose the disclosures of said patents to realize the Invention.

In its basic version, this invention concerns a first, flat pack, quickly assembled and locked for cylindrical, hamburger type sandwiches and other similar food. A second version of the invention consists of two half-shells, manually preformable, with ultra-rapid assembling-locking once preformed, with limited stackability. In a second variation, the pack is made of two half-shells, preformable on automatic machines directly into a stacking position. The packs can then be inverted into a manual filling, assembly and locking position, specifically designed for professional use (particularly at rush hour in fast-food restaurants).

DETAILED DESCRIPTION OF THE PREFERRED EMBODIMENTS

Figure 1:
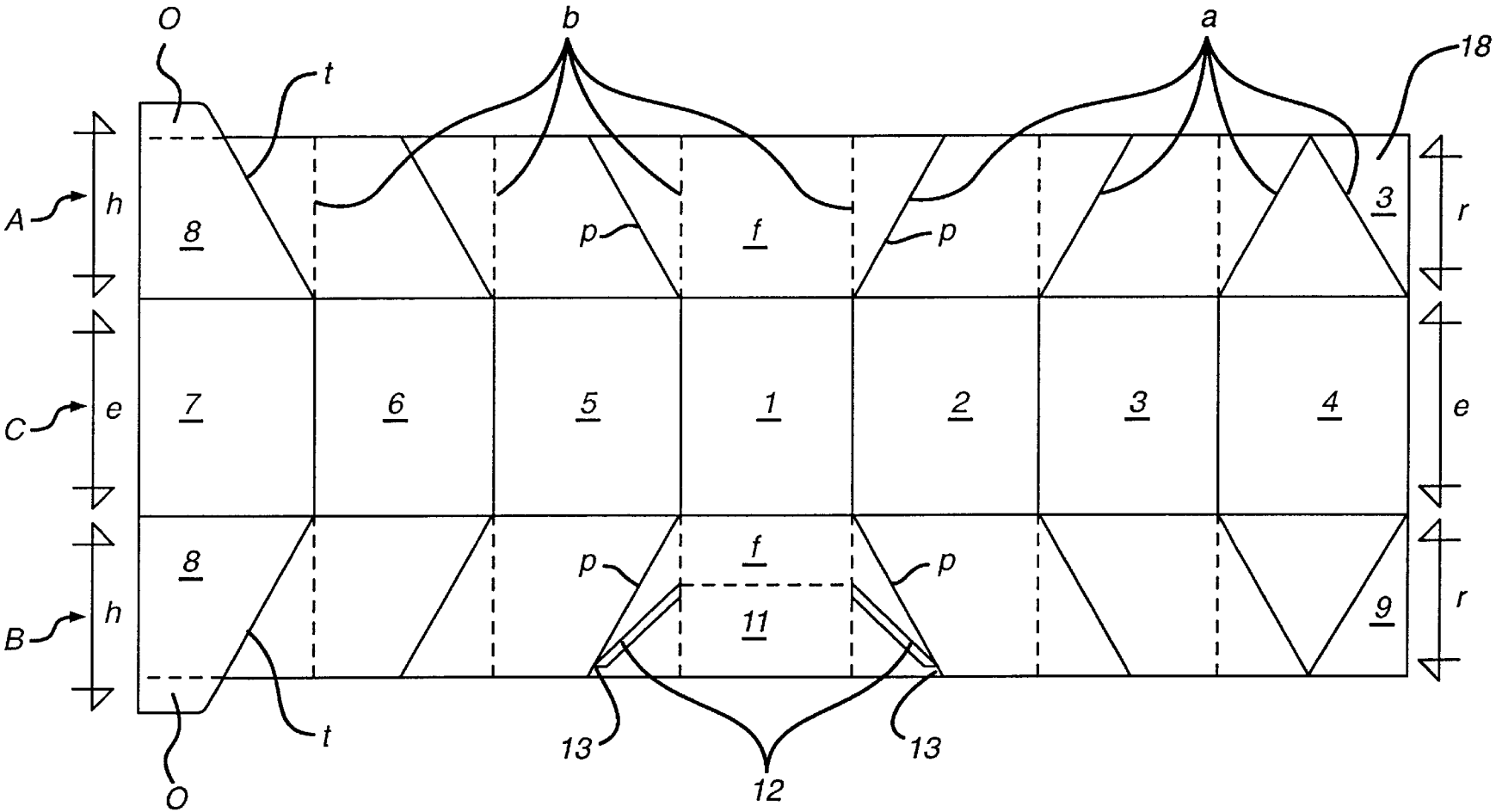
FIG. 1 is a top plan view of a blank from which a pack in accordance with one embodiment of the present invention may be formed.

FIG. 1 is a top view of the core concept of the Invention, purposely presented for the construction of a pack with regular hexagonal cross-section, as on the one hand, it allows the optimal reading of the figures, and on the other hand, it is one of the preferred embodiments of the Invention.

The thin sheet material used could preferably be a thin paperboard or microflute, grease-proofed in its thickness or at least on its internal surface, completely recyclable, and weighing between 180 and 250 grams per square meter.

A pack according to this basic version is obtained by cutting a suitable area (with a minimum of scraps) using a flat die applicable under pressure. This area resembles a stretched rectangle.

The blank can also be obtained from a paperboard roll cut during unwinding.

The scores marking the beginning of the pleats are obtained by means of a non-cutting tool attached to the cutting tool, and capable of imprinting on each side of the paperboard an indentation along various lines representing fold lines.

The fold lines shown in full lines (a) on FIG. 1 define groups of outward pleats.

The fold lines shown in broken lines (b) on FIG. 1 define inward or support pleats.

Figure 2:
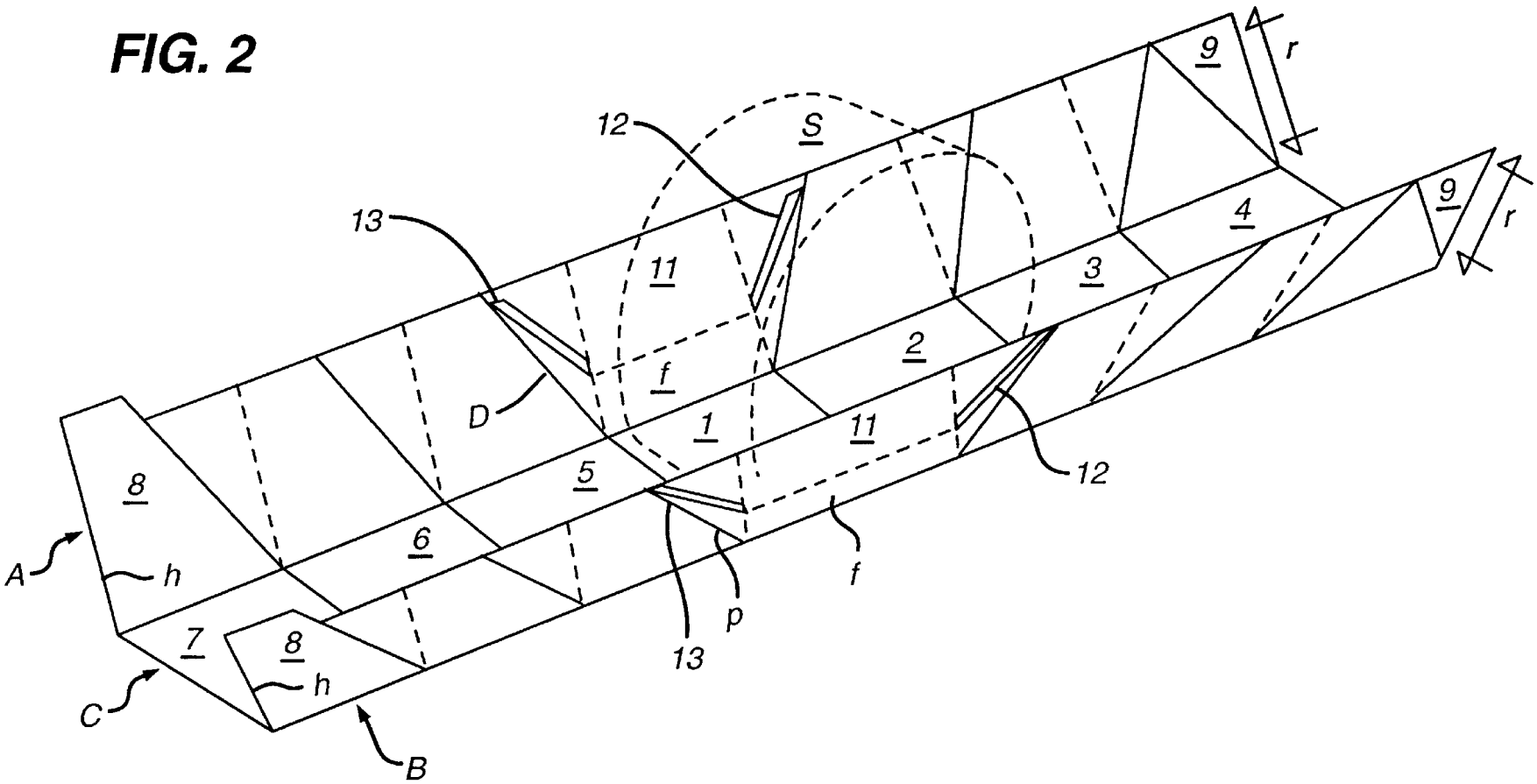
FIGS. 2–6 are isometric views showing the folding sequence of the blank of FIG. 1 to form a completed pack.

FIG. 2 takes FIG. 1 after the first folding. It shows that two strips A and B are symmetrically arranged around a strip C to form the pack.

Shown in the horizontal on this strip C, the width (e) of which corresponds to the thickness of the hamburger (S) to be packed, is an internal panel (1) designed to receive the hamburger vertically. This panel is the pivotal panel of the system; the wrapping panels (2), (3), (4), (5), (6) and (7) have the same dimensions as panel (1) in this regular hexagonal presentation.

Once the hamburger is placed on the pivotal panel, it is held in this vertical position by bringing back toward the hamburger with the thumb and index of one hand the two opposed symmetrical panels (f) (on strips A and B) FIG. 1.

In this basic version the height (r) of strips A and B (and, therefore, of panel (f)) is preferably equal to the radius of the hamburger to be packed.

With the other hand sliding under the pack and raising the integral panels (7), (6) and (5) FIG. 1, the type (b) inward pleats form naturally toward the inside of the pack and symmetrically on each strip A and B, and come to rest on the hamburger and tighten around it. The function of pleats (b) here is essential.

The lateral and symmetrical panels (8) which are of a height (h) slightly greater than (r) consolidate and stabilize this tightening by the penetration of their extending tab (o) between the panel (f) and the hamburger, this being the first step of the wrapping process of (approximately) two-thirds of the volume of the hamburger.

Figure 3:
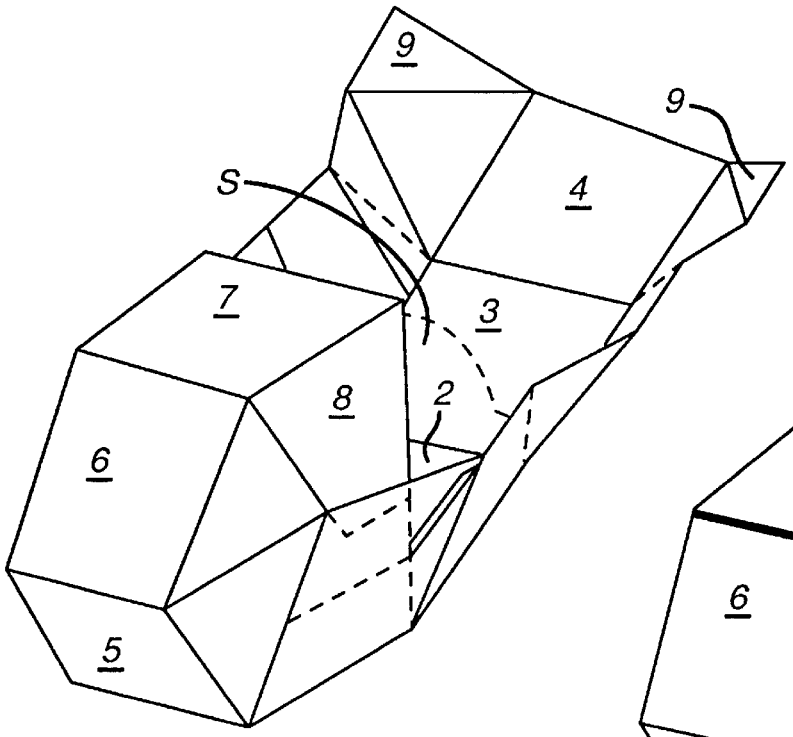
Figure 4:
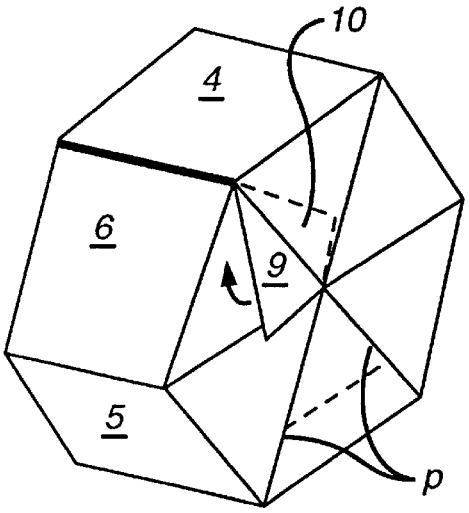

The wrapping action of the last third is done by laterally holding between the thumb and index finger of one hand the thus obtained fixed structure delimited by panels (1), (5), (6) and (7), integral with each other, and with the other hand raising panels (2), (3) and (4) FIG. 3, thereby forming and setting the corresponding inward lateral pleats resting against the hamburger which, at the end of wrapping, brings panel (4) to completely cover panel (7) FIG. 4 to achieve an absolutely compact assembly needing only to be locked.

Several solutions may then be envisaged: the most immediately apparent is to fold over the symmetrical triangles (9) of panels (18) located on both sides of panel (4) behind the pleats (t) of panels (8) respectively; FIG. 4 shows in a dotted line (10) the folding of triangle (9) behind the pleat (t) of one panel (8).

The wrapping and locking operation occurred without panel (1) ever leaving its original position on the horizontal plane where the wrapping process normally takes place, and the hamburger has remained completely immobile during the 4 to 5 seconds the operation lasted, before being returned to a flat position in its pack and on its base to preserve its integrity.

FIGS. 1 to 20 show a pack structure of regular hexagonal cross-section, the diameter of the hamburger being approximately that of the circle inscribed inside the hexagon.

Pack structures of square or pentagonal cross section or any other, preferably of polygonal cross section are possible.

However, the regular hexagonal cross section design turns out to be the best as the volume loss in the six 120° angles is only slight, the useful length of the blank is economical compared to packs of pentagonal or square cross section which are discussed later, and finally, as in the latter packs, the number of lateral pleats is perfectly controllable during forming and affords a tight fit.

In addition, the hexagonal and pentagonal packs have a pleasing appearance.

From the heptagonal cross section to the geometric limit of the circle cross section, the disadvantages of this basic concept of the Invention mostly stem from the difficulty of organizing the too numerous support pleats and outward pleats.

Figure 5:
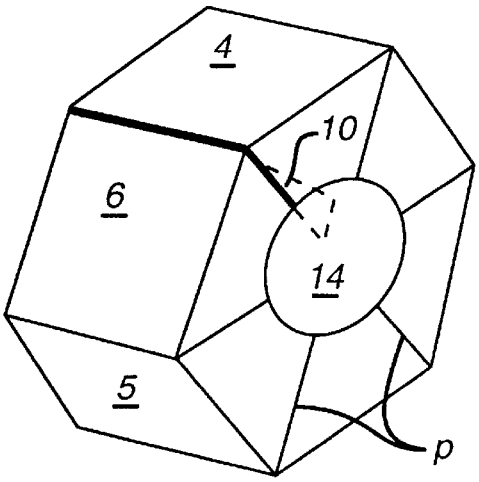

FIG. 5 shows an adhesive patch (14) glued on to reinforce the tucked-in pleat lock (10).

Figure 6:
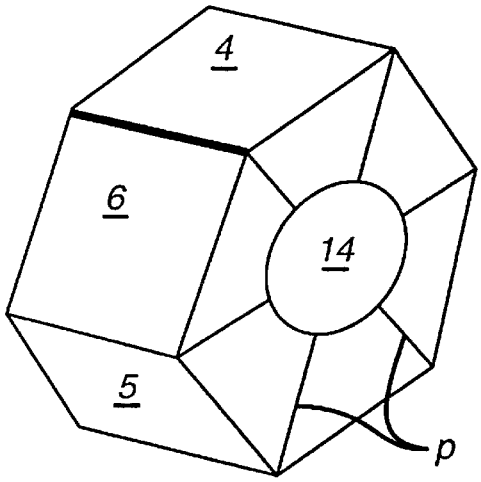

FIG. 6 shows a glued adhesive patch (14) as the sole lock, the pleat (9) being completely eliminated here during diecutting of the paperboard.

Figure 7:
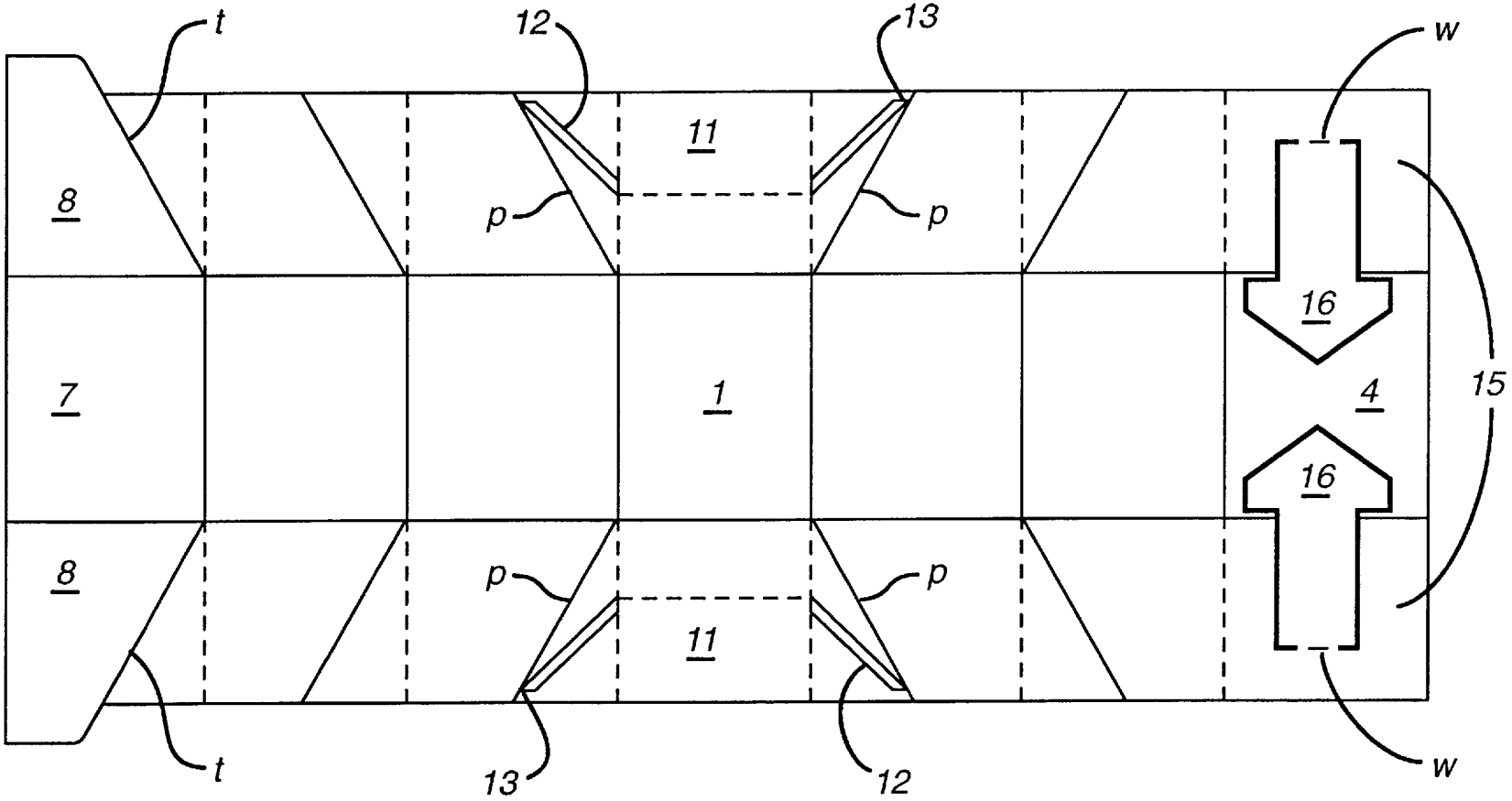
FIG. 7 is a top plan view of a blank from which a pack in accordance with an alternate embodiment of the present invention may be formed.
Figure 8:
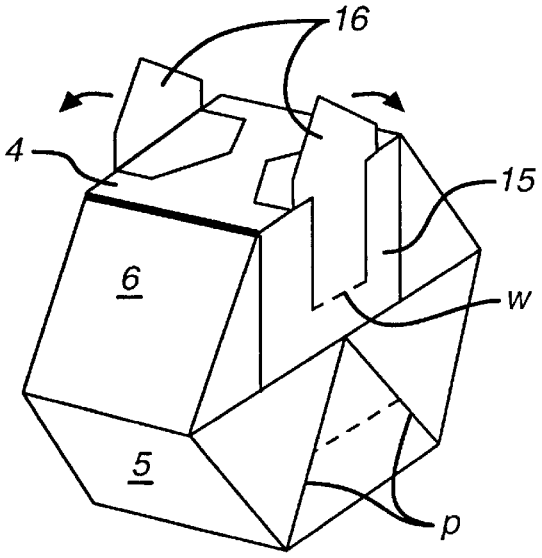
FIGS. 8–9 are isometric views showing the locking sequence during formation of the blank of FIG. 7 into a completed pack.

As explained earlier, the symmetrical arrangement of the pack around the pivotal panel (1) implies that the lateral panels (f) which are symmetrical in relation to panel (1) are each limited by two inward pleats of type (b) and two outward pleats of type (a) designated by (p) on FIG. 1 and FIG. 7. Once the pack is formed, both pleats (p) can be used as the female anchoring elements for an interesting lock design.

In FIG. 7, panel (4) and panels (15) symmetrical in relation to (4) show cut anchors (16) having hinges (w) securing them to these panels (15).

These anchors which are the male elements of this locking system, can be punched toward the outside of the pack (FIG. 8), and folded over their hinges (w) in such a way that the tips of each anchor are capable of locking the pack by sliding behind the external pleats (p) symmetrical to each other in relation to panel (f).

Figure 9:
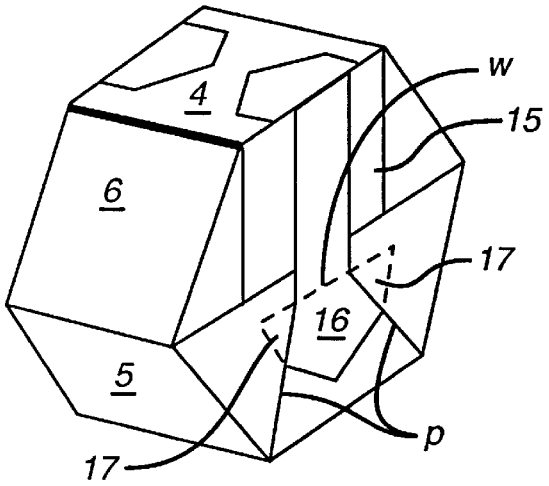

This lock, which is shown in FIG. 9, is easy to achieve as well as effective.

Figure 10:
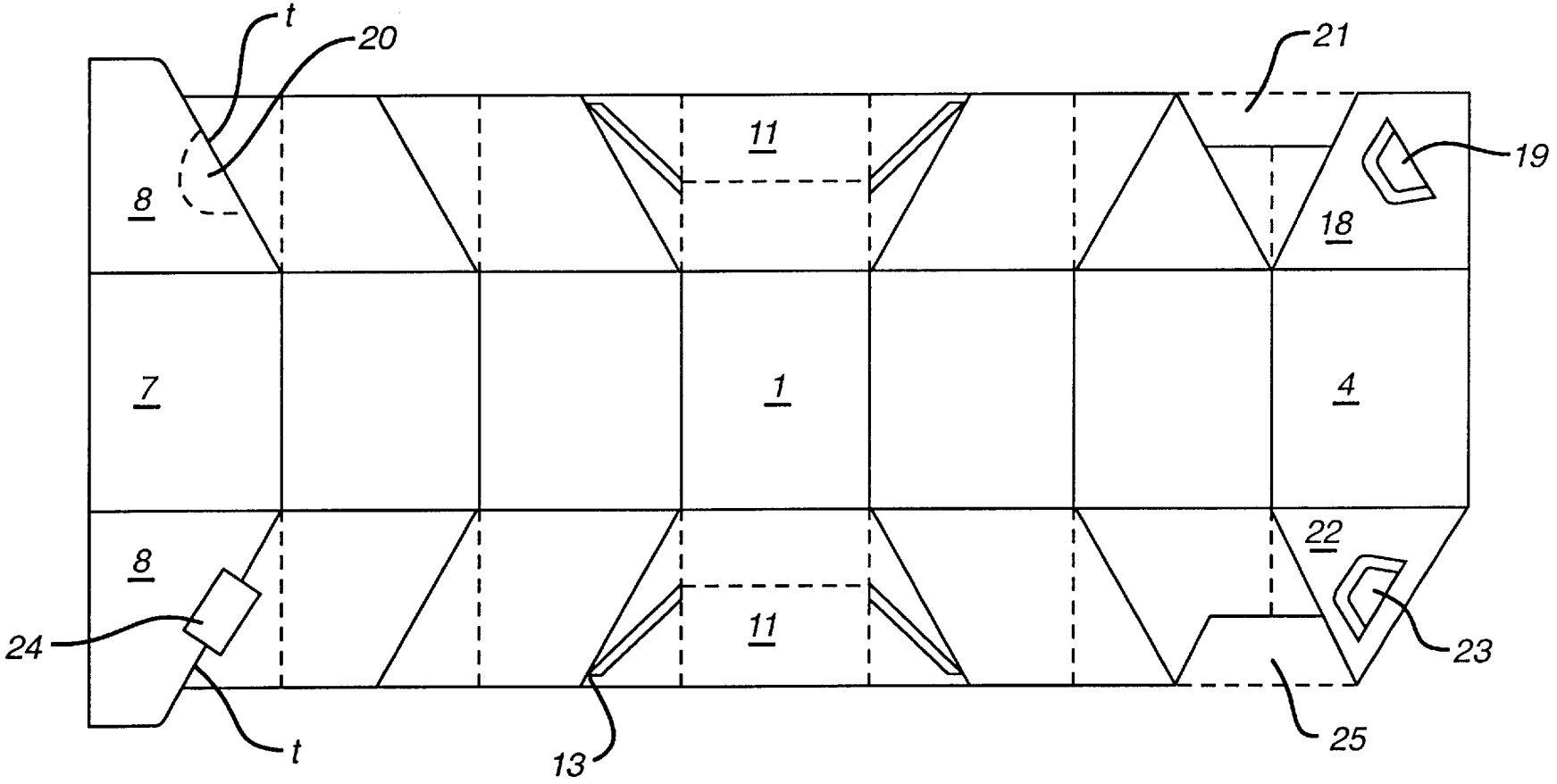
FIG. 10 is a top plan view of a blank from which a pack in accordance with a further alternate embodiment of the present invention may be formed.
Figure 13:
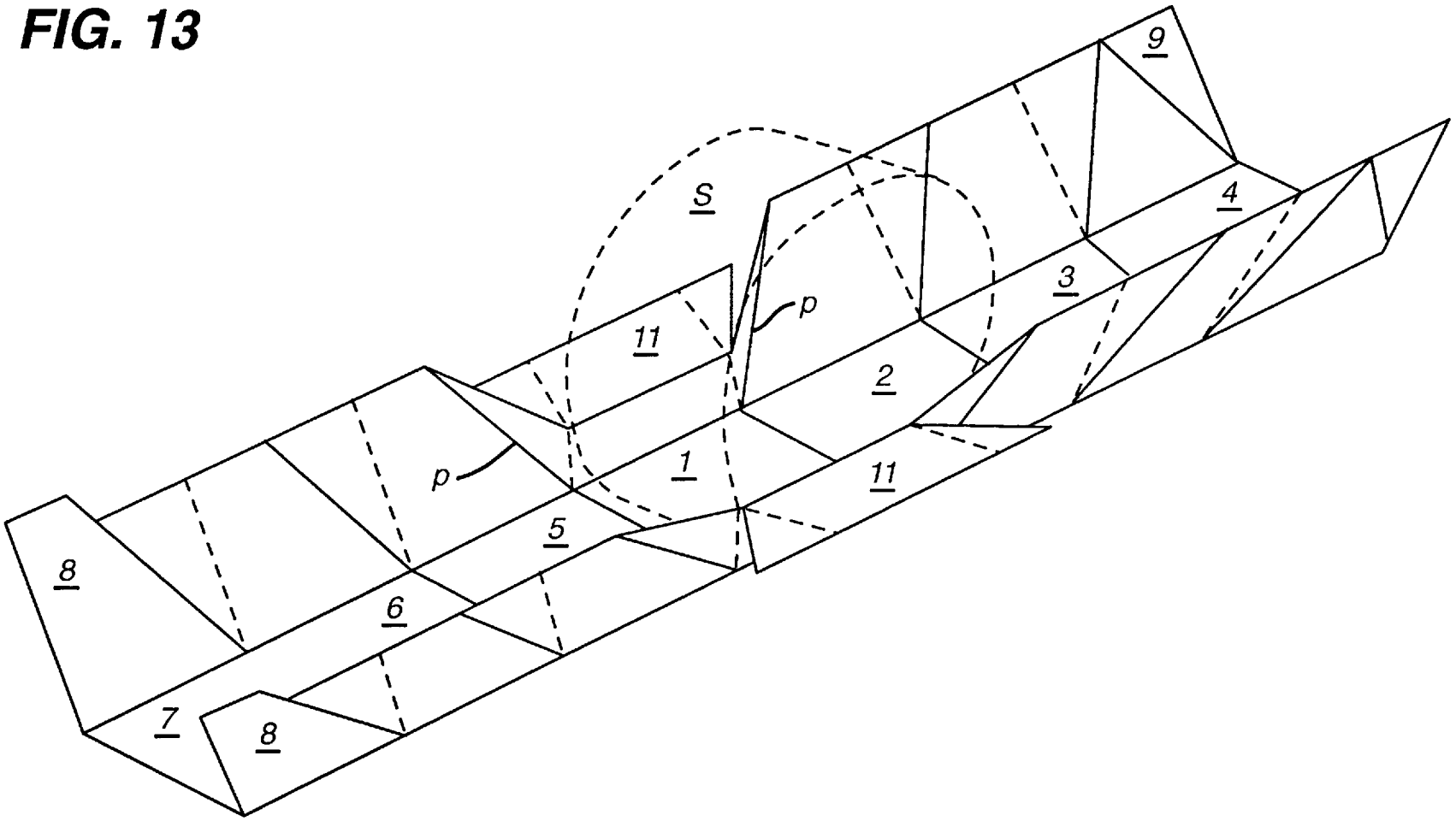
FIG. 13 is an isometric view of the pack formed from the blank of FIG. 1, showing the pack opened for consuming the packaged sandwich.

FIG. 10 shows a wide tab (19) cut out from panel (18), hinging on that panel, and catching at (20) behind the external pleat (t) of panel (8). This catch is facilitated by a cutout (21) allowing the lock shown in FIG. 11.

This tab lock is the fastest to implement, and its strength can be insured by optimizing the tab (19). It is the preferred lock of the Invention in this basic version, preferably in its various regular polygonal cross sections.

Figure 12:
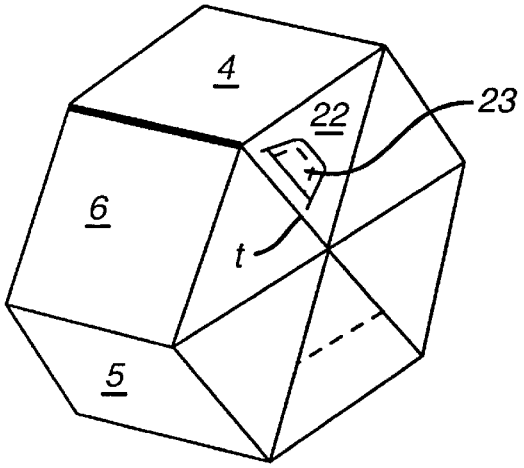

Similarly for the lock also shown in FIG. 10 by the tab (23) cut out on panel (22), hinged on this panel and catching in (24) behind the external pleat (t) of panel (8), the catch is facilitated by a specific cut-out (25) allowing the lock shown in FIG. 12.

Figure 11:
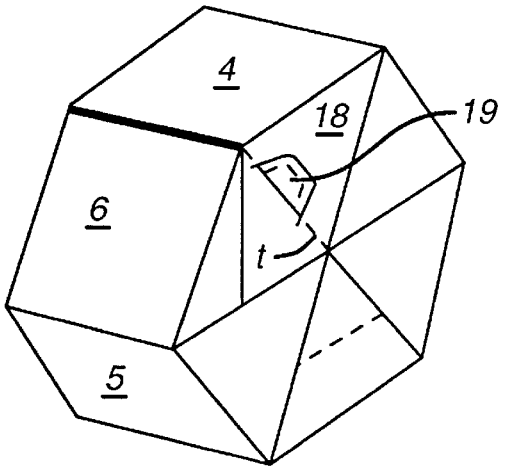
FIGS. 11–12 are isometric views showing the locking sequence during formation of the blank of FIG. 10 into a completed pack.

The difference between the lock in FIG. 11 and that in FIG. 12 resides only in the fact that the tab (23) is inside panel (22) and not outside as shown in FIG. 11.

The tab (23) is better integrated into the pleasing appearance of the pack, although its implementation, while easy, is less immediate than that of the tab (19) which remains preferred due to a better locking time.

FIG. 2 shows on each side of panel (1) and originating from panels (f) two cutouts (12) symmetrical in relation to (f) and held back by limit points (13) at the edge of strips A and B. When the limit points (13) are popped by pulling the panels (f) toward the outside of the pack, two symmetrical cut-out areas (11) are then delimited and held in an external hinge on panels Upon opening the pack FIG. 13 and popping the limit points, the lip-shaped areas (11) retract (or cut out) to allow total comfort of consumption, as the hinge is parallel and close to the pleat between (f) and (1).

In addition, to insure total comfort, one simply tightens with the thumb and index finger of each hand the strips A and B on each side of the hamburger so it is securely held with the four fingers on the pivotal panel (1) while biting into the hamburger.

According to whether one starts eating an almost whole hamburger or finishes eating it, the pack can be increasingly deployed for utmost eating ease and finally, after consumption of the hamburger, the pack can be crushed and tossed at a location where it is picked up for recycling (this location is generally provided in fast-food places).

So far the description covered a flat generic pack and its folding system with a number of variables allowing different types of locks that are easy to achieve and all quick locking, with a preference for the tab (19) FIG. 10, more efficient in actual assembly time.

It is now proposed, starting from this basic version of an initial flat pack, to advance, in a first evolution, to a second pack which, once manually formed, is particularly quick to assemble and lock. This requires the manual preparation in hidden time (or preferably in idle time), starting from a pack such as shown in the flat in FIG. 14, of two preformed half-shells (FIG. 15) which, once the hamburger is placed on the pivotal panel (1) (vertically if the pack is open toward the top in an horizontal balance, or horizontally if the pack is lying on a plane and open horizontally) can be folded over each other, with panel (4) covering panel (7) or vice-versa.

Figure 14:
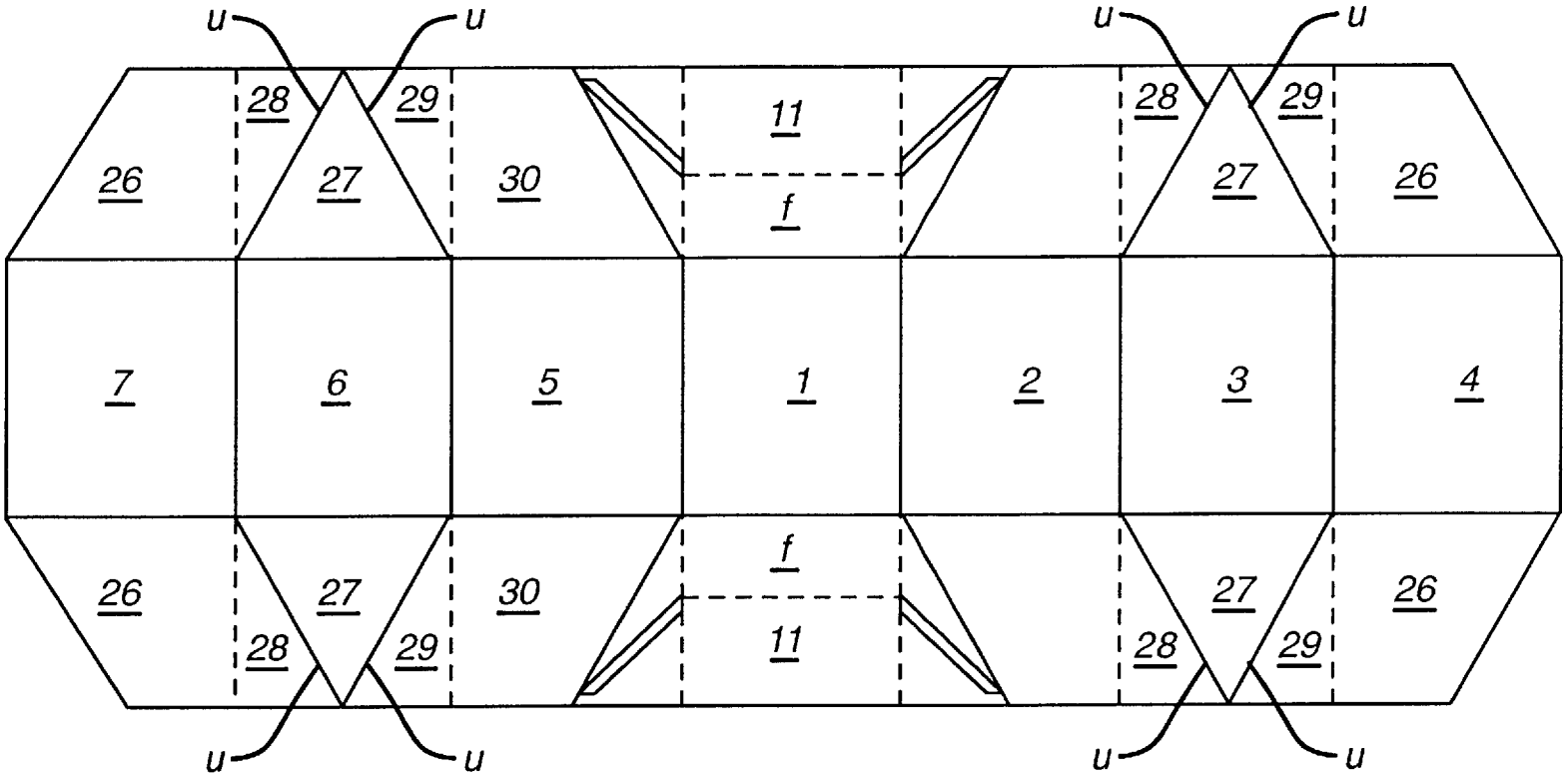
FIG. 14 is a top plan view of a blank from which a pack in accordance with a further alternate embodiment of the present invention may be formed.

Compared to FIG. 1, FIG. 14 is totally symmetrical in relation to its central strip including panels 1 to 7 and to the strip perpendicular to it including panel (1) panels (f) and lips (11) hinging on (f).

As can be seen in FIG. 14, the panels (26) have been troncated from triangle (9) FIG. 1, and are now devoid of any fold line.

However, the panels (27) have two outward pleat lines (u) and two inward pleat lines forming rectangles triangles [sic] (28) and (29).

Figure 15:
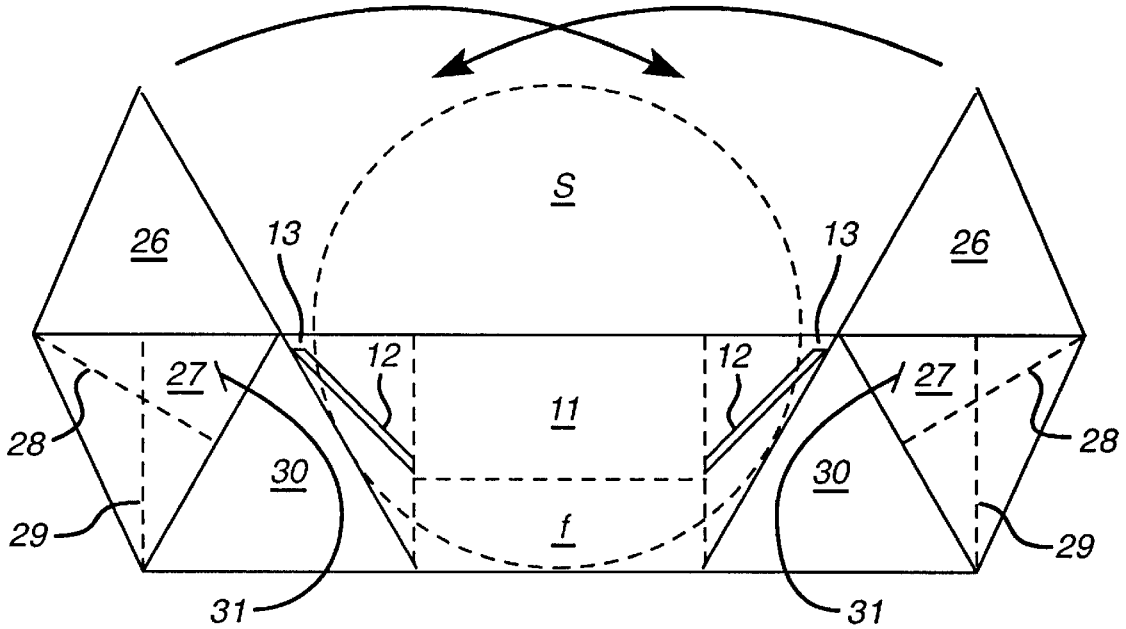
FIGS. 15–16 are isometric views showing the folding sequence during formation of the blank of FIG. 14 into a completed pack.

FIG. 15 shows in a lateral view how it is possible, starting with the folds in FIG. 14 to form two symmetrical half-shells shown by the visible external panels (26), (27), and (30).

The external panel (27) hides the two folds (28) and (29) set one on top of the other behind the panel (27) inside the pack so that a simple fastening in area (31) can lock together from the inside the external panels (26), (27) and (30) to achieve a perfectly shaped and strong half-shell.

The other half-shell is obtained in the same manner.

The fastening can be traditional, but considering the application, it is best to consider a fastening through punching/embossing, thus eliminating any metal staples and permitting the inclusion of a logo or a stamped-on brand.

This type of fastening can be done by a commercially known device.

Once the assembly consisting of the two half-shells is obtained, the hamburger is quickly introduced against the pivotal panel (1), and the assembly is locked by bringing together with a slight pressure of both hands the two half-shells which come down one on top of the other to counter the tension effect created by the setting up of the external (moveable) pleats on the internal (fixed) pleats around the hamburger on each side of panels (f).

Generally, no further locking is required if the proper light weight board has been selected, in the correct caliper and grade for best temperature and even humidity resistance if the humidity is of a nature to soften the pack and harm its lock.

Figure 16:
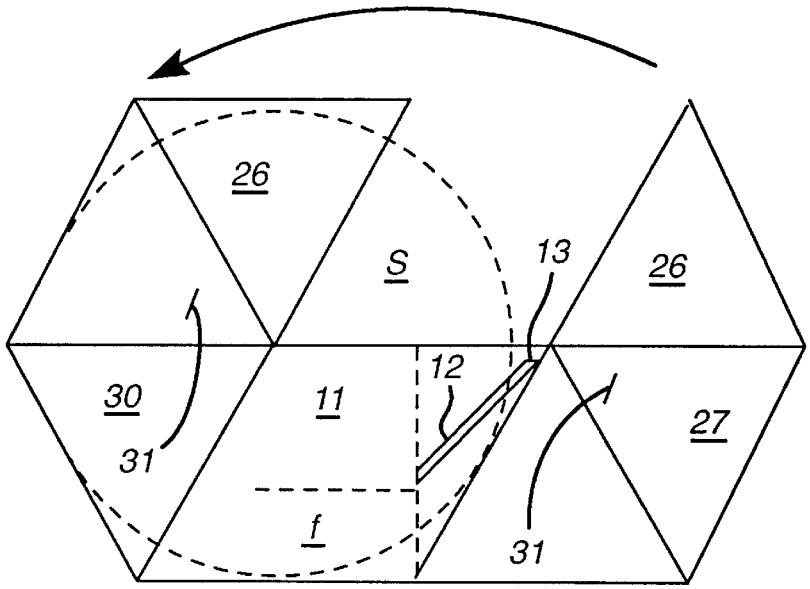

FIG. 16 shows FIG. 15 after the folding down of one half-shell.

In addition, in the regular hexagonal configuration the packs with preformed half-shells FIG. 15 are stackable.

However, stacking here presents two major problems:

first, it must be achieved under vertical pressure as these packs to be stacked horizontally on top of each other have two symmetrical concavities each consisting of the two half-shells, which may cause distortions in the pack beneath.

Secondly and consequently, the number of stackable units is very small because in this doubly-concave and almost vertical configuration the saturation point is quickly reached.

Figure 17:
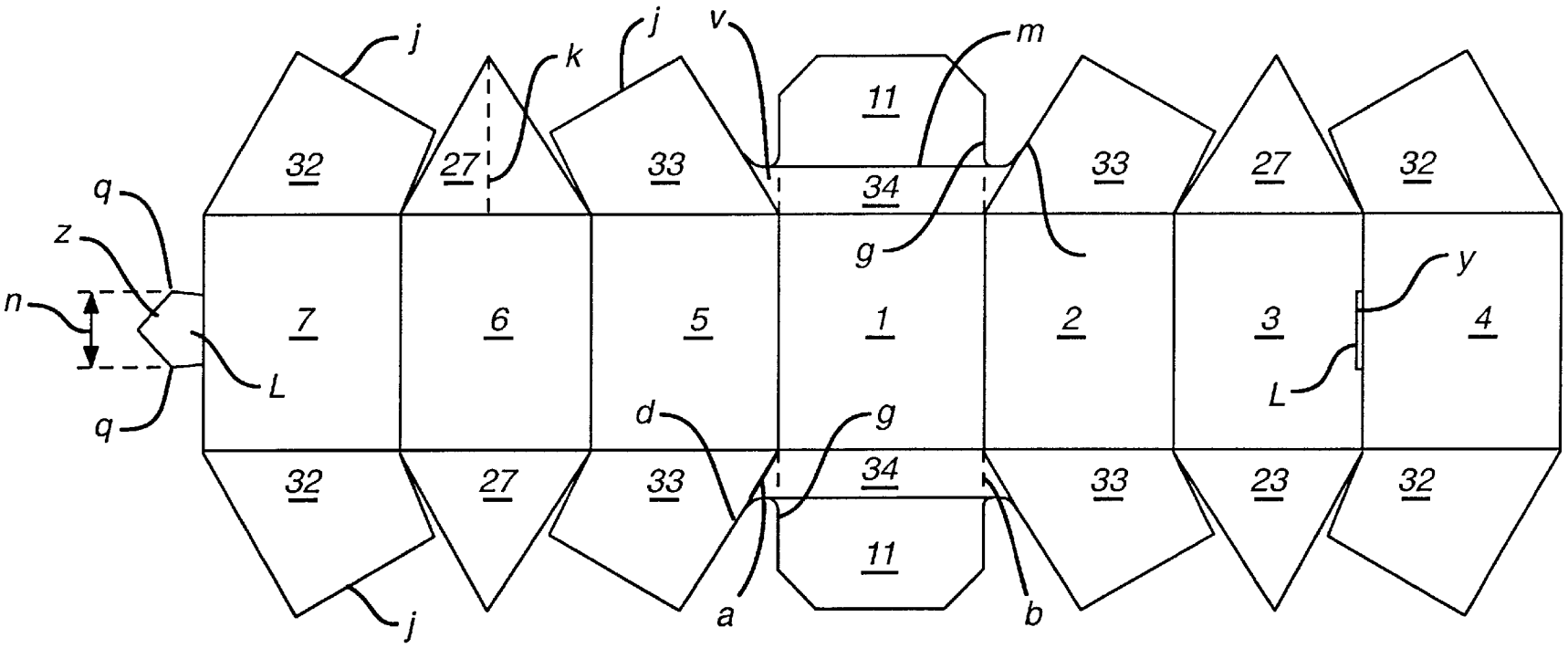
FIG. 17 is a top plan view of a blank from which a pack in accordance with a further alternate embodiment of the present invention may be formed.

Consequently, to eliminate the aforementioned problems and primarily to achieve unlimited stackability of the packs, it is necessary, as shown in FIG. 17 in a variation of FIG. 14, to cut the blank in a manner allowing the commercial production of a third optimally used double-tray pack, which is immediately facilitated by the fact that this double tray already has four oblique panels radially opposed two by two, and that the bottoms are narrower than the openings.

This embodiment, which is evolved from the preceding fastened manual design, is by far the most important of the Invention from the standpoint of large commercial applications.

During commercial production of these double trays under the Invention, the sides (j) of (32) and (33) of the blanks FIG. 17 (which are fed in series into an automatic machine called a tray former well known to professionals) are glued edge to edge on the internal panel (27) of the pack along height (k) of (27), preferably so that the internal lateral panels of the shells are completely lined by the panels set in during the gluing operation.

This results in the formation, by observing several technical requirements which are described hereinafter, of two attached half-shells, symmetrical in relation to panel (1) which has become the upper plane of the assembly (FIGS. 18 and 18A), both attached half-shells (or trays) hinged on the pivotal panel (1) resting in the horizontal on the outside planes of their two panels (6) and (3) respectively.

Figure 18:
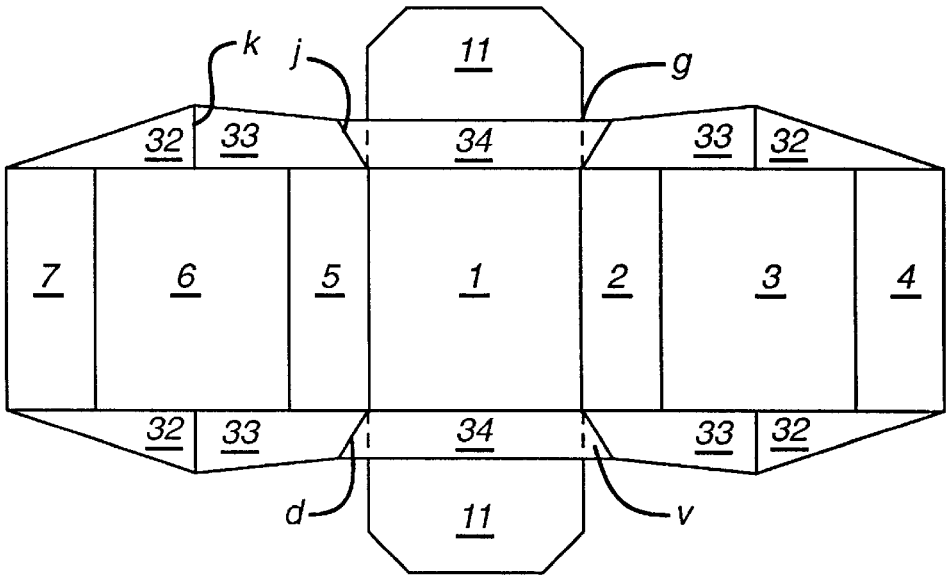
FIG. 18 is a top view of a preformed, collapsed pack formed from the blank of FIG. 17.

FIG. 18 is a top view of the assembly consisting of the two trays symmetrically organized in relation to panel (1), panel (1) being contiguous to each panel (34) (extrapolated from panels (f) of FIGS. 1 and 2) symmetrical in relation to panel (1), each panel (34) having a lip (11), also extrapolated from the figures on the preceding sheets, which can be moved inside or outside the pack along a groove or a horizontal perforation (m) located slightly above the base of the pack; the outward retraction of the opposing two lips (11) is provided to facilitate the full consumption of the sandwich (S).

Figure 18A:
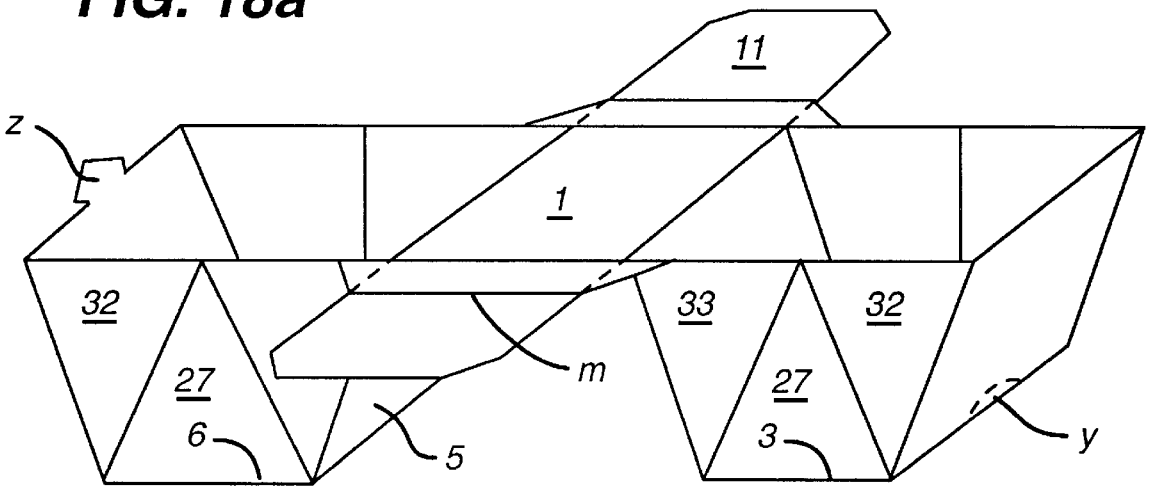
FIG. 18A is an isometric view of the collapsed pack of FIG. 18, erected to receive a sandwich to be packaged therein.

It is necessary now to explain the technical requirements enabling the commercial tray-forming on an automatic machine achieving the result shown in FIG. 18A, i.e. a double tray resting horizontally on its panels (3) and (6), and having panel (1) as its upper plane:

The first requirement is the proper reduction in the size of the outward (a) and inward (b) pleats, delimiting, after their reduction, two small triangles (v) at both ends of each hinge between panel (1) and (2) and panel (1) and (5), the small pleats (b) being located two by two in the extension of each of the two above-mentioned hinge pleats.

This reduction in size of the pleats (a) and (b) is necessary to avoid distorting and thus tearing the thin paperboard sheet during the forming process, when pressure-gluing the tray on the machine, which would occur if (a) and (b) were kept in their original size (FIG. 1).

Stacking is made possible here through the tensioning which occurs in the tray-forming process when gluing the small pleats (a), which causes a stable elastic, outwardly-rounded distortion of the half-shell corners along the pleats between panel (5) and panels (33) contiguous to (5) and along the pleats between panel (2) and panels (33) contiguous to (2) (FIG. 18).

When producing a tray with a well defined paperboard, the optimum length of a pleat (a) is that which allows to maintain the stable elastic distortion of the tray on both sides adjacent to its pivotal pleat with panel (1) without tearing the paperboard in the area where the outside ends of the pleats (a) meet the outside edges of the tray.

It is this stable elastic distortion which keeps the lateral panels of the half-shells flaring outward (the bottom of the half-shells is far narrower than the opening), and which allows them to be stacked at the end of the production cycle.

The thus fabricated pack can then, as explained hereafter, go from a stable stacking configuration to a stable filling configuration of the pack with the sandwich, and then to a stable closed configuration.

Starting from the stable stacking configuration, panel (1) and lateral panels (2) and (5) are roughly perpendicular one to the other two, and the passage to a stable filling configuration is possible only if pressure is exerted on each half-shell by bringing together (preferably at the same time and with both hands) panel (4) with panel (2) and panel (7) with panel (5) (FIG. 18A) and making them pivot upward each on its hinge pleat with panel (1) until the tension of pleat (a) is cancelled at the same time as the adjacent panels (5), (1) and (2) are positioned in the same plane, this plane assuming the role of swing plane of the pack to change configuration.

A return from the filling position to the stacking position is of no operational interest since the consumer will not have to do it.

But this is obviously feasible by doing the reverse motion which results in forcing the pleats (a) to be re-tensioned.

Technically speaking, the small moveable pleats (a) are the primary active element of the pack.

Their tensioning or untensioning is key to the passage of the pack from one major state (stacking position) to another major state (filling position), which we shall call the inverting of the pack (in one direction or another). In addition, they insure the stability of each of these major states, the equilibria of which can only be interrupted by constraint.

Filling of the pack is easy as it suffices to introduce the sandwich, on its edge against panel (1), either vertically or horizontally on a work plane, and to close it by bringing one half-shell into the other, by pivoting on the hinge pleats of panel (1). With this motion, the free lateral lips (11) FIG. 17, adjacent to panel (1) penetrate easily inside each half-shell above and below the sandwich. The pack is completely closed when panel (4)is perfectly superposed on panel (7).

The sandwich is then enclosed and thermally insulated until it is consumed.

During consumption, the half-shells are simply spread apart from each other and the sandwich appears on its edge against panel (1). It is comfortably held in the pack by finger pressure on both sides of the lateral lips (11).

The lips (11) are folded back outward without brusque motion when the mouth must reach the last portion. The pack has thus prevented to the very end any sauces spills, held back greasy food scraps and retained its initial attractive shape.

A second technical requirement of the pack is that in order to even better prevent any tearing of the thin paperboard sheet during tray-forming, particularly in the area of the small pleats (a) and (b) (especially during automatic high-speed production), it is very important that the four small triangles (v) on each side of (34) between the pleats of optimally reduced height (a) and (b), offer the best possible resistance to tear through the inclusion of spokes (g) and (d) respectively in the outer corners of the reduced size pleats (a) and (b) with the third side of triangle (v); these spokes are designed to eliminate the starts of any tears which are always possible when thin blanks, precut to an appropriate planned size have acute corners subject to stretches, pulls or pressures during trayforming.

But tray-forming per se is not the only cause of possible tear of the pack FIGS. 17 and 18 in the area of the small triangles (v):

Indeed, the sandwich (S) wrapping process per se starts with the manual setting up of the pack in the inverting operation described above, whose notable effect is that panels (5), (1) and (2) in that order return to the same plane in a stable configuration which is the hamburger filling configuration.

This manual inverting which takes less than a second (at the time of use or eventually in advance) causes the resetting into spring pleats of the four gussets delimited by the small triangles (v) tensioned earlier during tray forming.

It is clear then that the spokes (d) and (g) play an important role in the tear resistance at the time of manual inverting of panel (1), resulting in the pseudo verticalization of the two half-shells, with openings face to face, if by chance this inverting were to occur in a rough manner.

It is found, however, that in actual use the pack still retains sufficient spring action when a pleat (a) is torn on either tray, even if a pleat (a) is torn on each of them.

It should be pointed out that the polyethylene-lined paperboard packs provide perfect tear resistance both during tray-forming and manual inverting.

Figure 19:
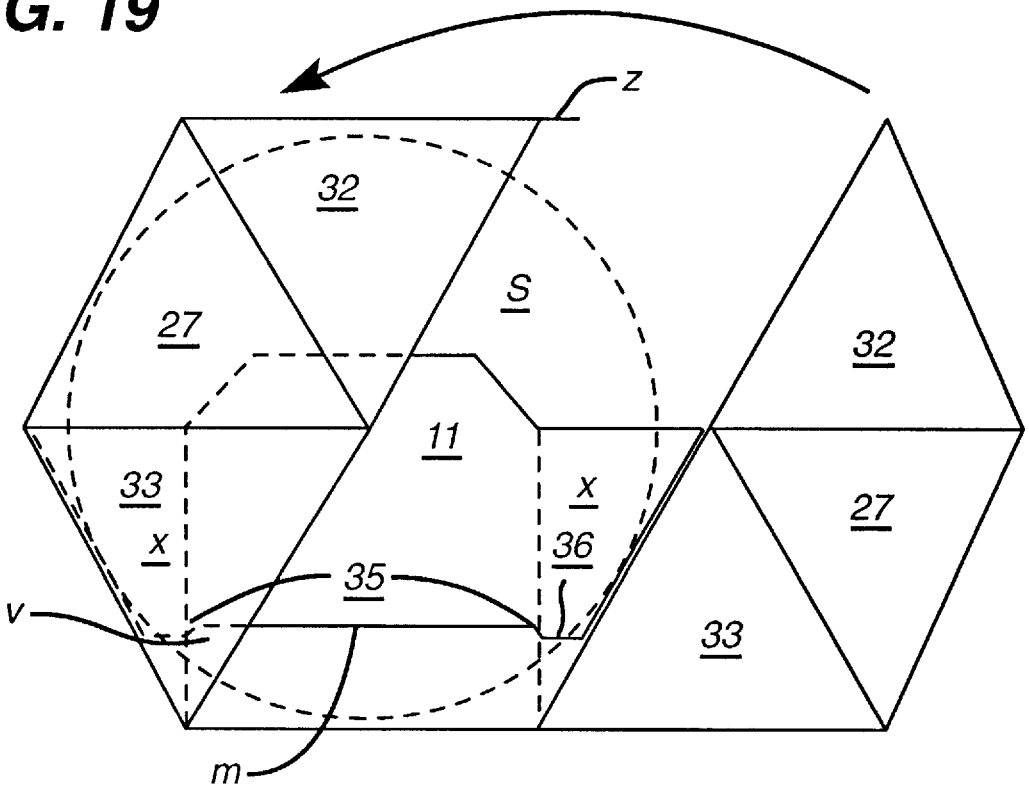
FIGS. 19–20 are isometric views showing the folding sequence during formation of the blank of FIG. 17 into a completed pack.
Figure 20:
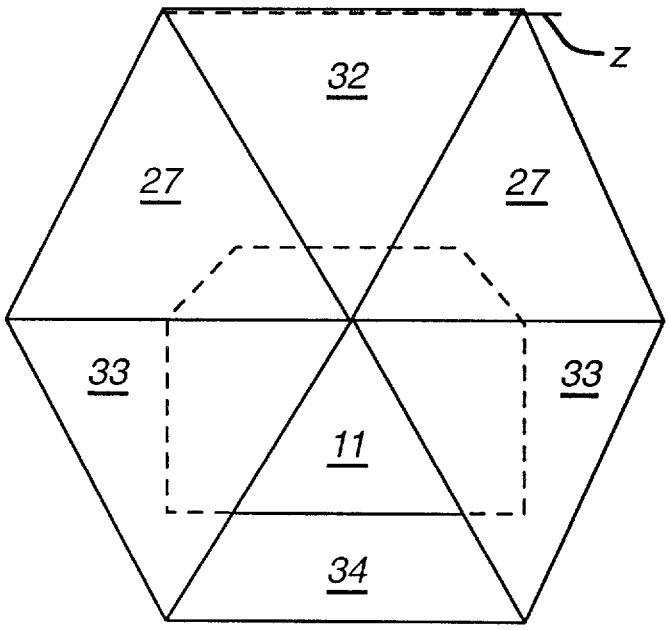

As another consideration, it should be noted that the wet heat released by a hot sandwich especially inside a pack such as described in FIGS. 15 and 19 has a natural tendency to soften the walls of said pack and to weaken its lock in particular, if such lock is not strong enough but without impeding the easy opening at the time of consumption of the sandwich.

There are many locking possibilities, but in the regular hexagonal design of FIGS. (17), (18) and (18A) preference shall be given to a lock securing the outside of panel (7) under the inside of panel (4), (or conversely) the inside of panel (7) under the outside of panel (4).

Of necessity, the chosen system shall not hinder the forming of the trays particularly in high-speed automated production.

FIG. 17 shows in the extension of the center of panel (7) a tab (z) in the shape of a rounded arrow with spurs (q) and (q') located on a line parallel to the outside edge of panel (7), separated by a distance (n); the segment common to the tab and the outside edge of panel (7) is of a size (L) slightly smaller than (n).

In the thickness of panel (3) and contiguously to the pleat of panel (3) with panel (4), a rectangular slot (y) approximately 1 to 2 millimeters wide and of length (L) is provided in the center area of the abovementioned pleat in such so that after the introduction of the sandwich into the pack, at the locking time the tab integral to one of the two half-shells can be snapped into slot (y) of the other half-shell under light pressure considering that (L) is slightly larger than (n); (4) then covers (7) perfectly.

The pack is very easily opened at the proper time by a slight outward pull to uncouple the shells.

Note that between line (q) (q') and the outer edge of panel (7) there is located an isosceles trapeze of large base (n), of small base (L), the height of which must be in approximate relation of one millimeter for a pack made from a thin sheet of about 2 to 3 tenths of a millimeter; the selection of the isosceles trapeze affords the possibility of a self-adjusting lock on the oblique sides of the trapeze.

It should further be noted that the panels (34) with the lips (11) can be of different design than those on FIGS. (17) and (18). The requirements here are:

First, the height of panel (34), lip (11) included, must be greater than the radius of the sandwich (S) so that once the pack is closed over the sandwich, the panel (34) does not allow partial visibility of the sandwich toward the center of the pack, but rather that it protects the sandwich up to above its diameter.

The second requirement is that the pack must also be perfectly enclosed laterally to insure the best temperature retention prior to consumption, particularly in the case of hot and wet sandwiches.

In FIGS. 17, 18, 18A, 19, 20, the sides of panels (34) have been suggested in the extension of the pleats (a) for easier reading of the figures; obviously, the opposing panels (34) can each be extended on both sides toward the lateral panels (33) (FIG. 19) within a maximum limit of two symmetrical sections (x), inasmuch as these equal sections added on both sides of (34) are completely detached from panels (33) as well as from the triangles (v) to allow the working of the spring gussets between the pleats (a) and (b).

In FIG. 19 which shows a major practical embodiment, the hinge (m) of the lip (11) is ideally located between the two tops (35) of pleats (a) on both sides of hinge (m); the segments (36) are cut out to allow the wings (x) of (34) to penetrate inside the shells at the time of closing of the pack and especially to allow the spring gussets between (a) and (b) to function freely.

The advantage of having larger panels (34) is, first of all, a better grip on the sandwich between the thumbs and index fingers of both hands by permitting a greater spread between them; next, better protection against dripping sauces, especially at the beginning of sandwich consumption; lastly, in the case of a pack which the restaurant can use either vertically or horizontally flat on a preparation counter, it is desirable that the sandwich (S) does not touch the counter, which could occur in the horizontal use prior to closing the pack in case of too wide openings between the panel (34) and the contiguous panels (33).

Figure 21:
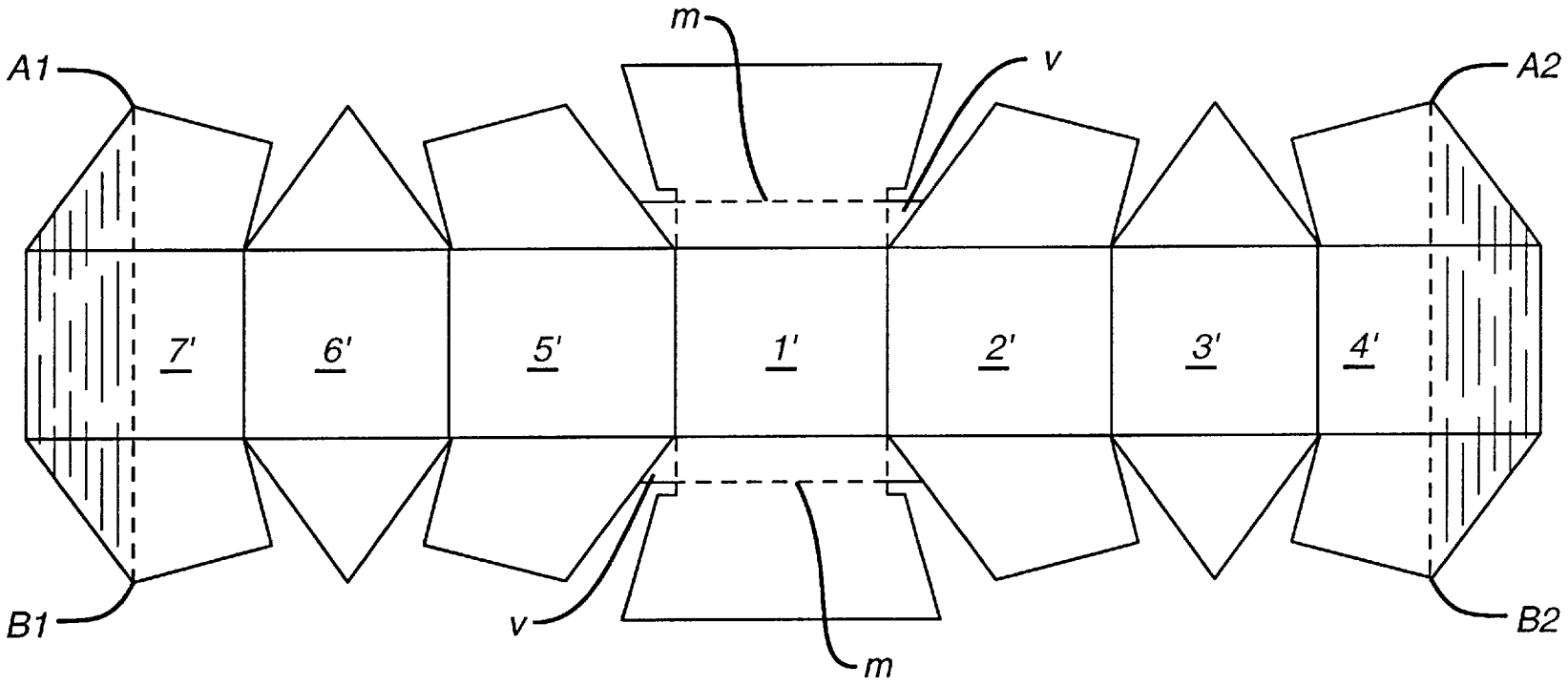
FIG. 21 is a top plan view of a blank from which a pack in accordance with a further alternate embodiment of the present invention may be formed.
Figure 22:
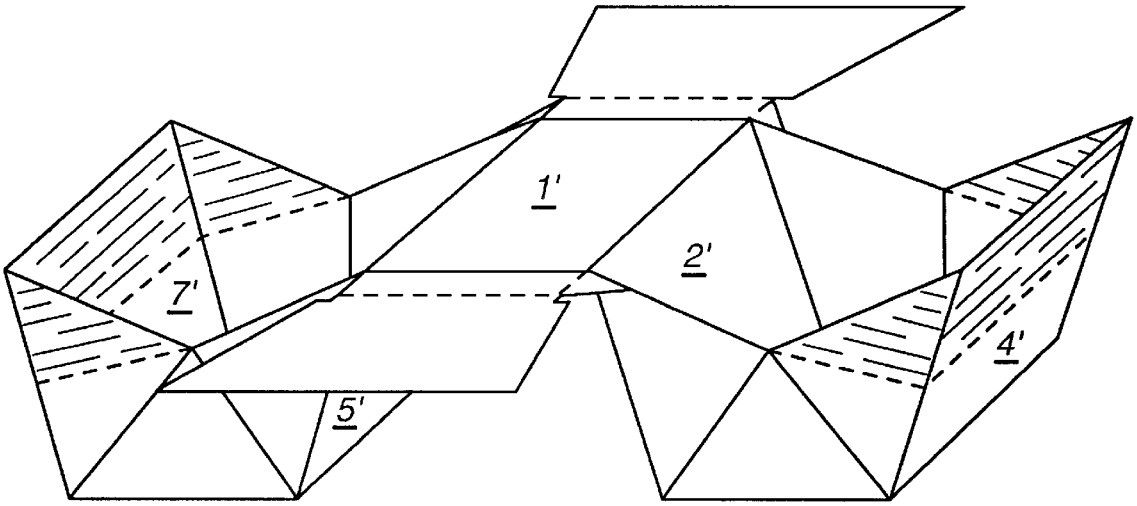
FIGS. 22–23 are isometric views showing the folding sequence during formation of the blank of FIG. 21 into a completed pack.
Figure 23:
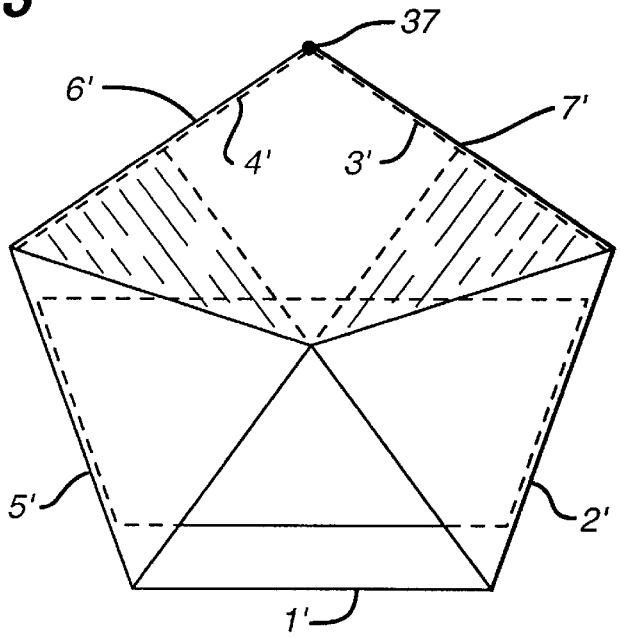

FIGS. 21, 22 and 23 show a pack according to the last type, capable of being commercially produced, but of regular pentagonal cross section.

It includes seven wrapping panels for five cross section sides, meaning that its locking principle involves four panels in two-by two's (panels (6'), (4'), (7') and (3')).

Indeed, when this pack is closed after the sandwich is placed on panel (1'), the inner side of (6') is perfectly superposed to the outer side of (4'), while in the same motion the inner side of (7') is perfectly superposed to the outer side of (3').

The closure can of course occur in the other direction.

In this pack of (preferably) regular pentagonal cross section, locking occurs naturally through the superposition of the (108°) angle between panels (3) and (4) on the (108°) angle between panels (6) and (7) at the end of wrapping, while allowing easy unlocking.

To economize paperboard, i.e., to use a shorter precut blank, the sections outside line (A1) (B1) on panel (7') and line (A2) (B2) on panel (4 ') can be eliminated. These sections are hatched on FIGS. 23 and 24.

Figure 24:
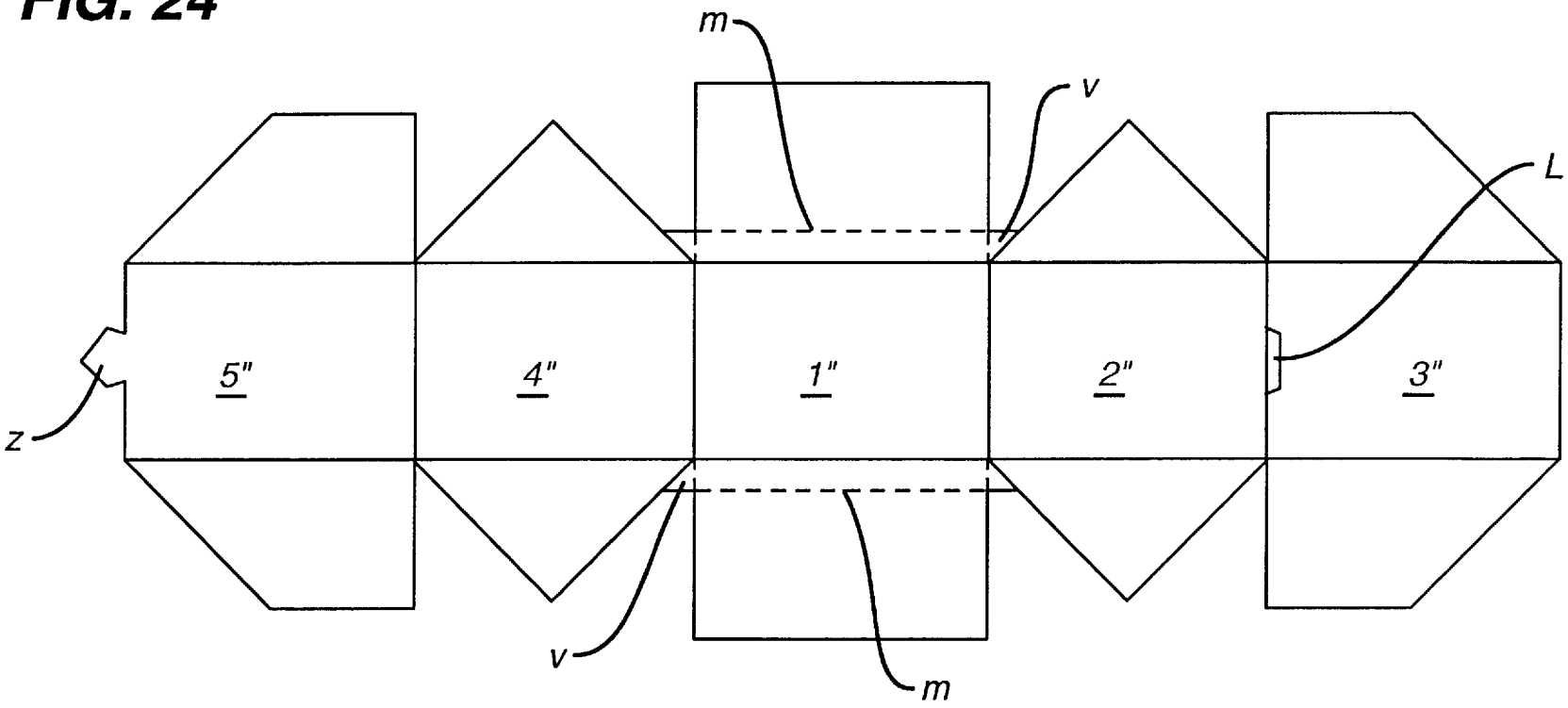
FIG. 24 is a top plan view of a blank from which a pack in accordance with a further alternate embodiment of the present invention may be formed.
Figure 25:
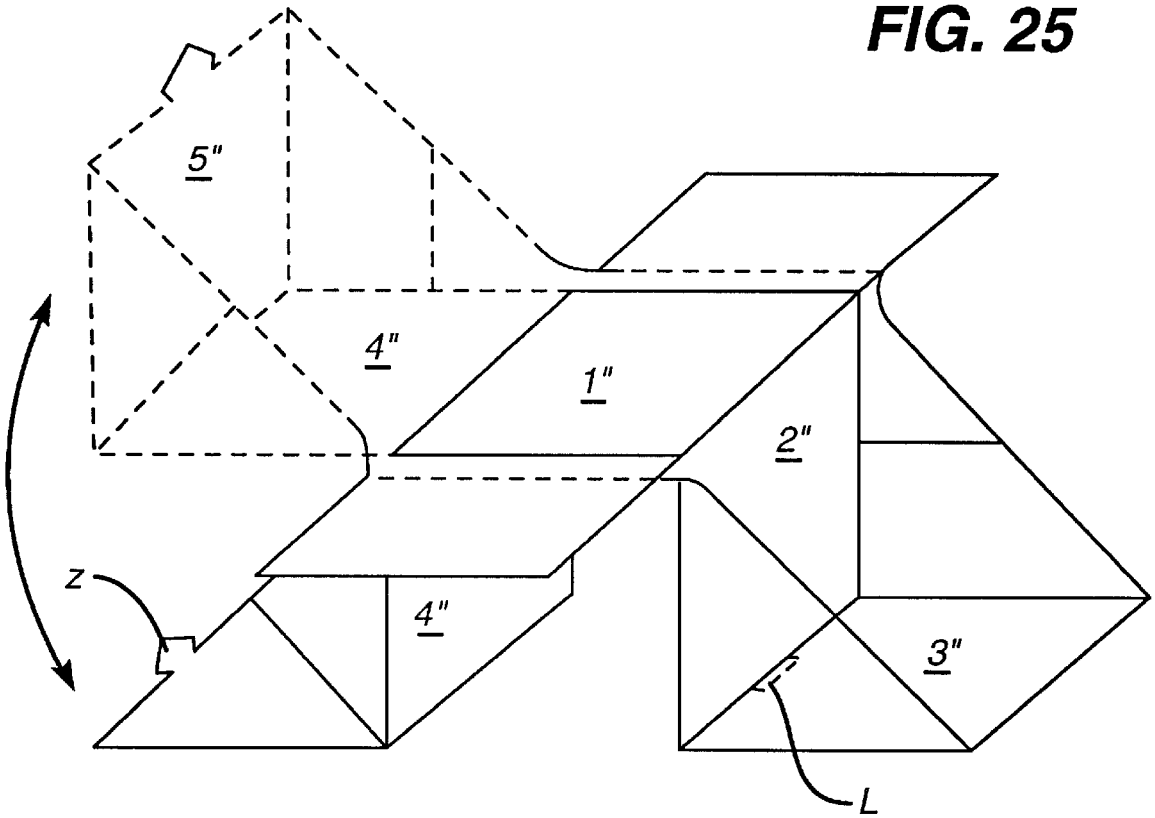
FIGS. 25–26 are isometric views showing the folding sequence during formation of the blank of FIG. 24 into a completed pack.
Figure 26:
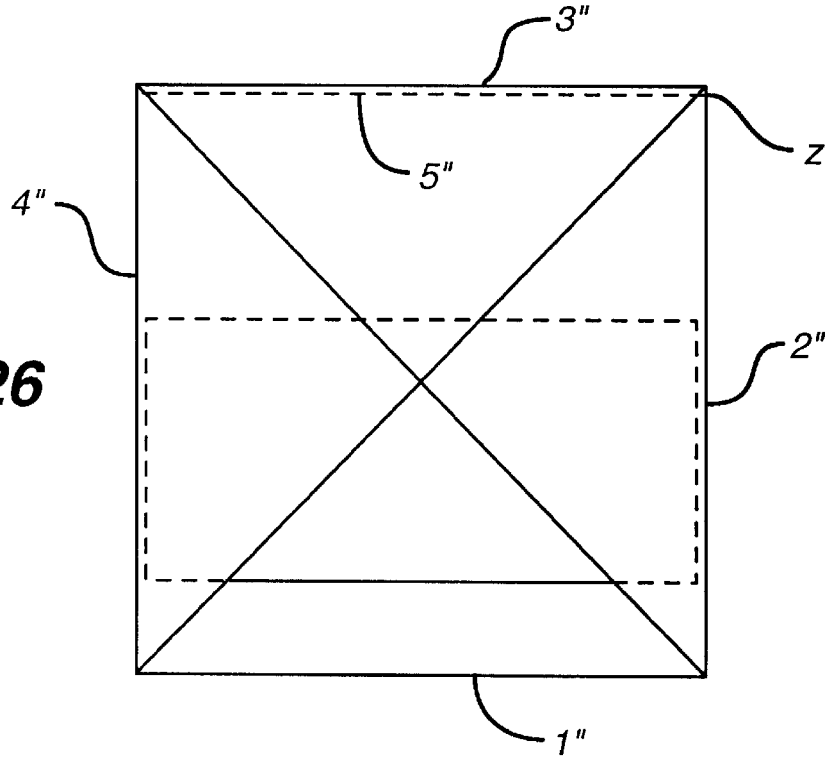

FIGS. 24, 25 and 26 also show a pack according to the last type, capable of being commercially produced, but of square cross section.

This pack includes five wrapping panels for four cross section panels, which implies a lock of the same type as for the pack of hexagonal cross section after perfect covering of external panel (5") by the internal panel (3") or vice-versa (FIG. 26).

It could be assumed that the stacking of this square pack is self-evident and does not necessitate the inverting technique after tray-forming. In actual application, it is found that the direct stacking of parallelepiped packs having as a base the sum of the contiguous panels (4"), (1") and (2") quickly reaches saturation unless the packs are flared, which would negate any covering of the panels (5") and (3") after wrapping, as these panels then present isosceles trapezes opposed by their large bases.

When creating round sandwich packs, the man of the art (upon precise analysis of the previously known art) does not seem to have made it his major concern to design a product precisely suited to the consumption of a hamburger or other foods of that type and shape, by considering all the consumer requirements as well as the needs of professionals (of the fast food restaurants in particular).

For consumers, the specific pack must be practical, since the sandwich is to be eaten in its wrap to avoid dripping sauces. The pack itself must invite them to do so naturally by its very configuration and should somehow suggest to the consumer that any other approach is excluded.

The consumer's comfort surely is not served when a hamburger is served in a rectangular box which does not present any notable features meeting the practical needs inherent to the consumption of a hamburger in its pack.

Comfort is also non-existent when the hamburger is offered in a pack made of two half-shells assembled on a single hinge as the sandwich is ensconced at the bottom of one half-shell with the all the unpleasantness already described.

Conversely, it is indeed comfortable when the sandwich, which is located on the wide hinge plane of the two easily unlocked half-shells, is easily accessible to the mouth and can be firmly held between thumbs and index fingers of both hands when bitten into, and at the appropriate time, the lateral lips of the pack fold back gently to allow the total consumption of the sandwich.

As far as the professional user is concerned, the Invention makes available to him an evolvable pack which he adjusts to his needs. If he manages a small restaurant, he can use the first or second pack, the shells of which can be formed ahead of time or in hidden time. If he operates a larger fast food restaurant, he will preferably use the third, stackable pack, of a slightly higher purchase price because it is immediately usable, although at a fairly low commercial series price.

The professional of a large (fast food type) restaurant will appreciate the image enhancement provided by the distinctive, omnipresent packs and the simple inducement to consumer loyalty generated by a clear improvement of his service to the consumer.

He will recognize in the Invention the answer to the complex problem posed by the inverting system of the double tray prior to its use, because of the kitchen counter space savings provided by the stackable packs.

It should be kept in mind that the inverting system under the Invention exceptionally allows the commercial production of stackable tray packs in unlimited quantity while their lateral panels are parallel to the utilization.

I claim:

1. A package for a substantially cylindrical food product, comprising:

an elongate central strip having a plurality of fold lines for defining a series of interconnected panels including a central panel disposed generally centrally along said strip with at least one other of said panels extending in series from each end edge of said central panel to an endmost one of said panels;

a central flap connected to each side edge of said central panel;

closure flaps connected to at least some of the side edges of said other panels;

said panels being folded with respect to each other whereby said endmost panels are cooperatively disposed to define a polygonal cross-section for said package;

said closure flaps and said central flaps being folded with respect to said panels to close said package; and each of said central flaps including means for defining an outer portion of said central flap wherein said outer portion is free from said closure flaps and means for permitting the outward folding of said outer portions for access to the food product contained within said package.

2. A package as defined in claim 1, wherein said package is formed from a blank comprising three longitudinal, substantially parallel strips, a center of said strips defining said elongate central strip, and outer ones of said strips each having some of said closure flaps formed therein, each of said central flaps being formed from one of said outer strips.

3. A package as defined in claim 2, wherein each of said outer strips has defined therein a series of alternating transverse and oblique fold lines extending thereacross, whereby said closure flaps define a series of pleats for at least partially wrapping a food product to be placed within the package.

4. A package as defined in claim 3, wherein said closure flaps include fastening means for forming the ones of said closure flaps and said other panels on opposite sides of said central panel into two half-shells, said half-shells and said central panel defining a partially preformed package.

5. A package as defined in claim 3, wherein said closure flaps, along at least a portion thereof, have a first width extending from said central strip to an outer edge of said closure flaps which is substantially equal to the radius of the polygonal cross-section of said package.

6. A package as defined in claim 5, wherein an endmost of said closure flaps includes a second width greater than said first width, thereby defining a tuck flap disposed between the food product and others of said closure flaps for retaining said package in a folded condition.

7. A package as defined in claim 3, wherein a first endmost of said closure flaps includes a locking tab defined therein, and wherein an opposite endmost of said closure flaps includes means for retaining said locking tab defined therein, whereby said endmost closure flaps may be locked together to close said package.

8. A package as defined in claim 1, wherein said means for permitting the outward folding of said central flaps includes a fold line formed across each of said central flaps, each of said fold lines being disposed substantially parallel to said central strip.

9. A package formed from a flat blank for a generally cylindrical food product, the blank comprising:

three longitudinal and substantially parallel interconnected strips, a central of said strips being divided by a series of first fold lines extending thereacross into a series of panels, one of said panels defining a pivotal panel upon which the food product is received for packaging;

outer ones of said strips each being divided by a series of second fold lines extending thereacross into a series of lateral panels, including a pair of first lateral panels connected to said pivotal panel along third fold lines;

said first lateral panels being connected to adjacent ones of said lateral panels along ones of said second fold lines defined as lateral extensions of the ones of said first fold lines disposed on opposite lateral sides of said pivotal panel;

the ones of said lateral panels adjacent to said first lateral panels being provided with oblique fold lines originating at an intersection of said lateral extensions and said third fold lines;

each of said first lateral panels being provided with a fourth fold line extending thereacross parallel to said third fold line.

* * * * *